United States Patent [19]

Buscella

[11] Patent Number: 4,968,271

[45] Date of Patent: Nov. 6, 1990

[54] ELECTRICAL TERMINAL

[75] Inventor: Claudio Buscella, Verolengo, Italy

[73] Assignee: ITW Fastex Italia, S.p.A., Turin, Italy

[21] Appl. No.: 420,861

[22] Filed: Oct. 13, 1989

[30] Foreign Application Priority Data

Oct. 18, 1988 [IT] Italy ..... 67933 A/88

[51] Int. Cl.[5] ..... H01R 4/48

[52] U.S. Cl. ..... 439/860; 439/883; 439/856; 439/850

[58] Field of Search ..... 439/851–858, 439/861, 883, 859, 860, 862, 884, 885, 842, 845, 849, 850

[56] References Cited

U.S. PATENT DOCUMENTS

| | | | |
|---|---|---|---|
| 2,766,438 | 10/1956 | Kohler et al. | 439/861 |
| 3,845,456 | 10/1974 | Michaels | 439/422 |
| 4,203,646 | 5/1980 | Desso et al. | 439/858 |
| 4,669,808 | 6/1986 | Owen | 439/858 |

FOREIGN PATENT DOCUMENTS

| | | | |
|---|---|---|---|
| 0203009 | 11/1986 | European Pat. Off. | 439/883 |

*Primary Examiner*—David L. Pirlot

*Attorney, Agent, or Firm*—Schwartz & Weinrieb

[57] ABSTRACT

The electrical terminal serves to receive blade connectors of the Faston type and consists of a metal plate in which at least one perforation is formed by means of a punching operation and into which project at least two oppositely inclined resiliently deformable contact tongues, adapted to snap-engage a respective Faston connector, with respective flared ends; the tongues extend in a direction away from the plane of the plate and project from a first face thereof in a converging manner such that the flared ends are disposed substantially tangentially with respect to one another and form on a second face of the plate opposite the first a V-shaped seat adapted to receive the connector and having an aperture angle lying between 75° and 108°.

14 Claims, 1 Drawing Sheet

ELECTRICAL TERMINAL

FIELD OF THE INVENTION

The present invention relates to a female electrical terminal of the type into which an electrical male blade connector, for example of the Faston type, can be inserted in a disengageable manner.

BACKGROUND OF THE INVENTION

It is known to achieve rapid and disengageable electrical connections by means of the insertion of male blade connectors of the Faston type into female terminals formed with sheet metal tongues having folded longitudinal edges curled towards one another in such a way as to define twin seats into which it is possible to axially insert the male connector; this type of electrical connection, however, on the one hand does not always ensure correct contact pressures between the two elements of the connection itself, with the risk of poor electrical contact, and on the other hand is difficult to produce, in particular when the female terminals must allow for the insertion of male connectors perpendicularly with respect to the sheet from which the terminals are formed by means of punching and folding operations. In order to solve these problems it has been proposed to form female terminals with a rectangular perforation, along opposite edges of which are formed projecting inclined tongues obtained by means of a punching operation, defining together with the perforation, a V-shaped seat for the insertion of the blade connector which, especially if it is of the type having a central hole, is snap-engaged between the tongues. These terminals, however, have the disadvantage of not always ensuring a correct insertion of the male connector, and particularly of not permitting, after coupling, the subsequent withdrawal of the connector from the terminal.

OBJECT OF THE INVENTION

The object of the invention is that of providing an electrical terminal for receiving blade connectors, for example of the Faston type, which is simple to produce by means of punching and folding operations from a conductive sheet, which allows the male connector to be inserted perpendicularly with respect to the original plane of the conductive sheet, and which allows disengagement of the male connector after connection, while ensuring in each case an optimum electrical connection with the connector.

SUMMARY OF THE INVENTION

The aforenoted object is achieved by means of the present invention, which relates to an electrical terminal for blade connectors, in particular of the Faston type, which comprises a metal plate within which is formed, by means of a punching operation, at least one perforation within which there are at least two oppositely projecting inclined resiliently deformable contact tongues adapted to press together and snap-engage an associated connector, the tongues extending in a direction away from the plane of the plate, and projecting from a first face thereof, in a converging manner so as to form, upon a second face of the plate, opposite the first, and together with the perforation, a V-shaped seat adapted to receive the connector; characterised by the fact that the tongues are provided with respective flared ends disposed substantially parallel with respect to one another, tangential to a common plane disposed perpendicularly with respect to the plate and comprising respective inclined terminal edges which are bent with an inclination opposite that of the tongues.

BRIEF DESCRIPTION OF THE DRAWINGS

For a better understanding of the invention a nonlimitative description of an embodiment thereof is now given with reference to the attached drawings, in which like reference characters designate like or corresponding parts throughout the several views, and wherein.

DETAILED DESCRIPTION OF THE INVENTION

Figure 2:
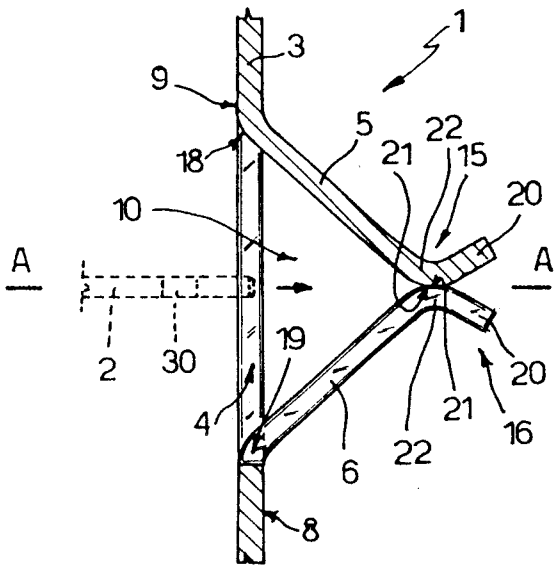
FIG. 2 is a sectional side view taken on the line II—II, of the electrical terminal of FIG. 1.
Figure 1:
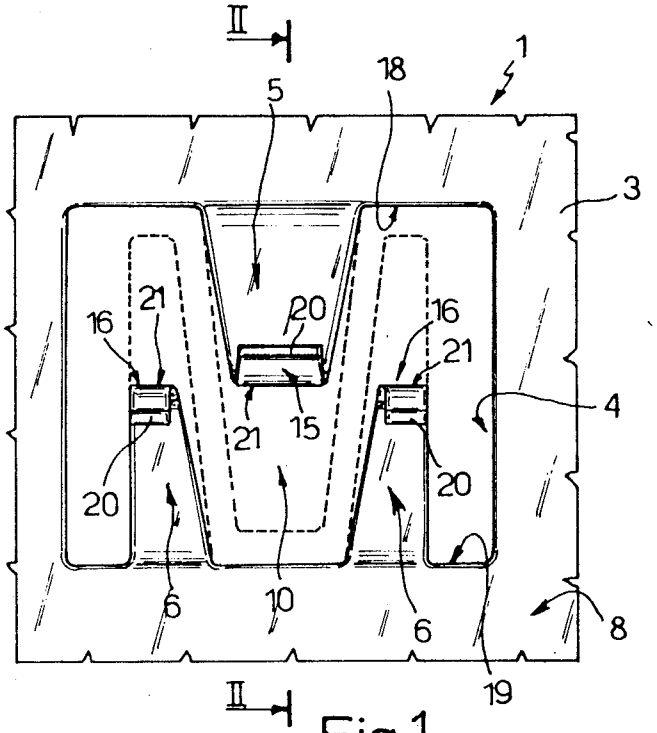
FIG. 1 is a plan view from above of an electrical terminal formed according to the invention.

With reference to FIGS. 1 and 2, the reference numeral 1 generally indicates an electrical terminal for an electrical blade connector 2, of known type, for example a Faston connector indicated in broken outline only in part for simplicity; the electrical terminal 1 comprises a metal plate 3 made from an easily worked conductive material, such as, for example copper, brass or similar particular alloys, in which there is formed by means of a punching operation at least one perforation 4, preferably of rectangular or square form, into which extend at least two (in the illustrated example, three) oppositely inclined resiliently deformable contact tongues 5 and 6 adapted to grip between them and snap-engage, in use, the connector 2. The tongues 5 and 6 extend in a direction away from the plane of the plate 3, and project from one face 8 thereof in a converging manner so as to form upon a second face 9 of the plate 3 itself, opposite the face 8, and together with the perforation 4, a seat 10 which is V-shaped in axial section, and which is adapted to receive the connector 2 in the direction of the arrow. The plate 3, of which for simplicity only the part surrounding the perforation 4 is illustrated, is known as a whole, and can be shaped in any way, such as, for example by punching the same from a metal sheet of predetermined dimensions, in such a way as to carry other terminals 1, even if of different dimensions, and in such a way as to form one or more electrical circuits of which the terminals 1 form a part; or can be shaped as a simple plate scarcely larger than the perforation 4 and provided, in a known way, with known means not illustrated for simplicity for mechanical and electrical connection to an electrical circuit, also known and not illustrated for simplicity.

According to the invention the tongues 5 and 6 are provided with respective flared ends 15 and 16 disposed edgewise, tangential to or intersecting a common plane A—A disposed in correspondence with the middle of the perforation 4, parallel to respective sides 18 and 19 of perforation 4 from which the tongues 5 and 6 extend, and perpendicular to the plate 3, in which plane the connector 2 is intended to move upon insertion or withdrawal. Each end 15, 16 comprises a respective inclined terminal edge 20 bent so as to lie at an inclination opposite that of the associated tongue 5, 6, and a curved root portion 22 joining the terminal edge 20 with the rest of the associated tongue 5, 6; respective convexly curved surfaces 21 of the curved root portions 22 of the ends of the tongues 5, 6 defining respective facing contacts of the terminal 1, adapted to cooperate with the connector 2 so as to ensure the passage of electric current between connector 2 and the terminal 1, and vice versa.

The tongues 5, 6 have, according to the invention, an inclination such as to form between them, in the relaxed state, an angle lying between 78° and 108°; this range of values having been shown, on the basis of experimental tests conducted by the applicant, to be critical to obtaining, simultaneously, both a high efficiency and ease of insertion and removal of the connector 2, and a good mechanical and electrical connection between the connector 2 and the terminal 1. Similarly, the bent terminal edges 20 of the flared ends 15 and 16 are shaped in such a way as to form between them an angle substantially identical to that formed by means of the tongues 5, 6 opposite the vertex with respect to the tongues 5 and 6; the presence of the flared ends 15, 16, and in particular the shape of these ends according to the latter arrangement, together with the presence of the curved portions 22, permitting the disengagement of the connector 2 from the terminal 1 even when the connector 2 is provided with a hole 30 as in the case of the majority of known Faston connectors, in that such prevents the ends 15, 16 from being permanently or fixedly disposed within this hole 30 while they nevertheless remain able to be snap-engaged within the hole 30 upon insertion of the connector 2 into the seat 10 whereby it is insured that the connector 2 is fixedly secured within terminal 1.

In the non-limitative example illustrated the terminal 1 is provided with three inclined tongues formed in alternately offset positions upon the sides 18 and 19 and which are tapered in a longitudinal sense; the tongue 5 is formed at a central position upon the side 18, and is integrally formed with the plate 3 by punching and folding thereof as indicated by means of the broken lines, and has in plan view the shape of an isosceles trapezium; the tongues 6, which are substantially identical with respect to each other in a mirror-image manner, are on the other hand formed at symmetrical positions upon the side 19 of the perforation 4, upon opposite sides of the tongue 5 and are integrally formed with the plate 3, again by punching and folding thereof, as indicated by means of the broken lines; the tongues 6 have in plan view a substantially right angle trapezium shape and have a width substantially equal to one half that of the tongue 5. In use the connector 2 is introduced into the seat 10 in the direction of the arrow (FIG. 2) causing resilient deformation of the tongues 5, 6 which flex away from the plane A—A in such a way as to permit the insertion of the connector 2 therebetween and upon which the surfaces 21 exert a grip by resilient reaction, exerting a predetermined pressure upon the connector 2 which simultaneously ensures both the mechanical fixing of connector 2 within the terminal 1 and the correct and efficient electrical connection between the terminal 1 and connector 2; and if connector 2 is provided with a hole 30 the portions 22 of tongues 5, 6 snap-engage into it, further improving both the mechanical fixing and the electrical contact of the connection. When it is necessary to disengage the connector 2 it is sufficient to withdraw the same from the seat 10 by exerting upon it a predetermined force so as to produce, again thanks to the presence of the flared ends 15, 16, a separation of the tongues 5, 6 with consequent release of the connector 2 and eventual disengagement of the portions 22 from the hole 30 if in fact the latter has been provided.

Obviously, many modifications and variations of the present invention are possible in light of the above teachings. It is therefore to be understood that within the scope of the appended claims, the present inventio may be practiced otherwise than as specifically described herein.

I claim:

1. An electrical terminal for blade connectors, comprising:

a substantially planar metal plate having oppositely facing first and second substantially planar surfaces;

a first resiliently deflectable contact tongue extending outwardly in a first direction from a first one of said first and second substantially planar surfaces of said substantially planar metal plate in a cantilevered manner from a first edge portion of said substantially planar metal plate and at a predetermined angle with respect to said first one of said first and second substantially planar surfaces of said substantially planar metal plate such that a first contact portion of said first contact tongue is disposed within a plane within which said blade connector is to be disposed and which plane is substantially perpendicular to a plane within which said substantially planar metal plate is disposed; and a pair of resiliently deflectable contact tongues extending outwardly in a second direction, opposite to said first direction of said first resiliently deflectable contact tongue, from said first one of said first and second substantially planar surfaces of said substantially planar metal plate in a cantilevered manner from a second edge portion of said substantially planar metal plate, disposed opposite said first edge portion of said substantially planar metal plate, and at a predetermined angle with respect to said first one of said first and second substantially planar surfaces of said substantially planar metal plate such that second and third contact portions of said pair of contact tongues are disposed upon opposite lateral sides of said first contact portion of said first contact tongue within said plane within which said blade connector is to be disposed, whereby said first, second, and third contact portions of said first contact tongue and said pair of contact tongues resiliently engage said blade connector.

2. An electrical terminal according to claim 1, characterised by the fact that said tongues have an inclination such as to form between them, in the relaxed state, an angle lying between 78° and 108°.

3. An electrical terminal as set forth in claim 1, wherein:

said contact tongues are integrally connected to said substantially planar metal plate.

4. An electrical terminal as set forth in claim 1, wherein:

said metal plate is fabricated from copper.

5. An electrical terminal as set forth in claim 1, wherein:

said metal plate is fabricated from brass.

6. An electrical terminal according to claim 1, wherein:

said electrical terminal comprises three inclined tongues extending in alternate offset positions from first and second sides of a perforate portion of said substantially planar metal plate having a substantially rectangular configuration.

7. An electrical terminal according to claim 6, characterised by the fact that said tongues are tapered in a longitudinal sense, the first of said tongues being formed in a central position on said first edge, integrally with said plate, and having in plan an isosceles trapezium shape, and second and third offset tongues, substantially identical with one another, being formed in symmetrical positions on said second edge, on respective sides of said first tongue and integrally formed with said plate; said second and third tongues being of substantially rectangular trapezium form in plan and having a width substantially equal to one half of that of said first tongue.

8. An electrical terminal as set forth in claim 1, wherein said first contact tongue and said pair of contact tongues extend outwardly from said first one of said first and second substantially planar surfaces in such a manner as to converge toward each other within said plane within which said blade connector is disposed so as to resiliently engage said blade connector.

9. An electrical terminal as set forth in claim 8, wherein:

second side surface portions of said first contact tongue and said pair of contact tongues define a convergent receptacle for guidably receiving said blade connector toward said plane within which said first contact tongue and said pair of contact tongues are disposed.

10. An electrical terminal as set forth in claim 1, wherein:

each of said pair of contact tongues and said first contact tongue further comprises a flared end portion disposed substantially tangentially with respect to each other within said plane within which said first contact tongue and said pair of contact tongues are disposed.

11. An electrical terminal as set forth in claim 10, wherein:

said flared end portions of said pair of contact tongues and said first contact tongue further comprise bent terminal ends which have an inclination angle opposite that of said pair of contact tongues and said first contact tongue, as viewed with respect to said first one of said first and second substantially planar surfaces of said substantially planar metal plate, such that said terminal ends are disposed substantially perpendicular to said pair of contact tongues and said first contact tongue, respectively.

12. An electrical terminal according to claim 11, characterised by the fact that said bent terminal ends of said flared ends of the tongues form between them an angle substantially identical to that formed by said tongues.

13. An electrical terminal according to claim 11, characterised by the fact that said flared ends of said tongues each comprises said inclined terminal end, and a curved root portion joining the terminal end to the rest of said tongue, respective convex surfaces of said curved root portions of the ends of the tongues defining respective facing contacts of said electrical terminal.

14. An electrical terminal as set forth in claim 13, further comprising:

aperture means defined within said blade connector for engagingly receiving said curved root portions of said contact tongues.

* * * * *